US006790002B2

(12) United States Patent
Kitazawa et al.

(10) Patent No.: US 6,790,002 B2
(45) Date of Patent: Sep. 14, 2004

(54) STEAM TURBINE AND POWER GENERATING EQUIPMENT

(75) Inventors: Morikazu Kitazawa, Yokohama (JP); Masataka Kikuchi, Chigasaki (JP); Kazuo Aoyagi, Tokyo-To (JP); Nobuo Okita, Ushiku (JP); Hiroyuki Oohira, Tokyo-To (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/203,411

(22) PCT Filed: Feb. 9, 2001

(86) PCT No.: PCT/JP01/00939

§ 371 (c)(1),
(2), (4) Date: Dec. 23, 2002

(87) PCT Pub. No.: WO01/59264

PCT Pub. Date: Aug. 16, 2001

(65) Prior Publication Data

US 2003/0143069 A1 Jul. 31, 2003

(30) Foreign Application Priority Data

Feb. 10, 2000 (JP) ..... 2000-033530

(51) Int. Cl.[7] ..... F01D 1/02
(52) U.S. Cl. ..... 415/220; 415/108
(58) Field of Search ..... 415/108, 214.1, 415/213.1, 220, 221, 100, 103, 102, 199.5

(56) References Cited

U.S. PATENT DOCUMENTS 3,628,878 A * 12/1971 Trassel et al. ..... 415/108

FOREIGN PATENT DOCUMENTS

| | | |
|---|---|---|
| JP | 61-123802 | 6/1986 |
| JP | 62-251408 | 11/1987 |
| JP | 07-158410 | 6/1995 |
| JP | 10-169414 | 6/1998 |
| JP | 11-311132 | 11/1999 |

OTHER PUBLICATIONS

Shadan Houjin Karyoku Genshiryoku Hatsuden Gijutsu Kyokai, "Kagen Kyokai Kouza Turbine, Hatsudenki", Jul. 31, 1995, Kabushiki Kaisha Nisshinsha, p. 11.

* cited by examiner

*Primary Examiner*—Edward K. Look
*Assistant Examiner*—Kimya N McCoy
(74) *Attorney, Agent, or Firm*—Finnegan, Henderson, Farabow, Garrett & Dunner, L.L.P.

(57) ABSTRACT

The present invention solves problems of securing high-temperature strength at elevated temperatures and of preventing steam leakage that arise when high-pressure, high-temperature steam is used for driving a steam turbine, and problems of preventing the occurrence of rubbing due to the suppression of the excessive elongation difference and of minimizing steam leakage from shaft seals. A double-wall casing structure is arranged at an area corresponding to stages from a high-pressure first stage (7) to a predetermined high-pressure stage arranged on an upstream side of a high-pressure final stage (8); and a single-wall casing structure is arranged at an area corresponding to stages which follows said predetermined high-pressure stage.

11 Claims, 8 Drawing Sheets

STEAM TURBINE AND POWER GENERATING EQUIPMENT

TECHNICAL FIELD

The present invention relates to a casing structure for a steam turbine included in a thermal power generation system installed in, for example, a combined power plant, and a power generating system using the steam turbine provided with the casing structure.

BACKGROUND OF THE INVENTION

Recently, many combined-cycle power plants provided with a gas turbine and a steam turbine in combination have been constructed. Generally, the improvement of steam conditions is directly related with the improvement of the efficiency of a power plant provided with a steam turbine. Therefore, the increase of the pressure and temperature of steam for driving a steam turbine included in a combined-cycle power generating system has been required to improve the efficiency of the power generating system and to enhance the output of the power generating system.

As shown in FIG. 8, a casing 110 of a high-pressure stage 5 of a conventional steam turbine for combined-cycle power generation is a single-wall casing. Usually, the thickness of the wall of the single-wall casing must be increased to improve the pressure withstand strength when inlet steam pressure is raised. In the event that the pressure and temperature of the steam are raised to improve the efficiency of the steam turbine provided with the conventional single-wall casing and to enhance the output of the same, an increased pressure stress and an increased thermal stress are induced in the casing owing to increase in the thickness of the wall of the casing. The casing is thus damaged by thermal fatigue or high temperature low-cycle fatigue during the operation, and the operation of the turbine affected.

The risk of steam leakage from the horizontal flange of the casing is increased by increase in thermal deformation of the casing, resulting in the marked degradation of the reliability of the steam turbine. Steam leakage involves the direct discharge of high-temperature, high-pressure steam into the atmosphere, which is fatal to the operation of the steam turbine, and increases the risk of fire and injury.

Since an excessively high thermal stress is induced in the casing having a thick wall at the start of the steam turbine, it must take a long time for starting up time of the turbine to reduce the level of the thermal stress. However, in a case, such as a combined-cycle power plant which is required quick start-up, the extension of the starting up time delays the start up of the combined-cycle power plant and increases the operating cost of the power generating system.

When the output of the steam turbine provided with a conventional single-wall casing structure is increased by raising the pressure and temperature of the main steam, the casing must be made of 12-Cr steel or 9-Cr steel, which has strength at high temperatures but expensive, instead of a conventional low alloy steel. The high material cost of the casing is a principal factor that increases the cost of the steam turbine.

The linear thermal expansion coefficients of the 12-Cr steel and the 9-Cr steel are smaller than those of conventional low alloy steels, typically CrMoV steels. Therefore, the thermal expansion of a casing made of 12-Cr steel or 9-Cr steel is smaller than that of the conventional casing. Thus, the expansion difference (the difference between the respective axial thermal expansions of the casing and the rotor with respect to a reference position corresponding to a thrust bearing of the turbine) is greater than that in the conventional turbine. This results in reduction of axial clearances between the rotor, i.e., a rotating body, and the components of the casing, i.e., stationary members. Due to this, the rotor and the components of the casing contact with each other, resulting in so-called axial-rubbing, causing the intense vibration of the shaft that hinders the continuation of the operation of the turbine.

Recently, a conventional combined-cycle steam turbine employs a double-wall casing structure including an inner casing 111 and an outer casing 112 entirely covering turbine stages from the high-pressure first stage 7 to the high-pressure exhaust stage 8 of the high-pressure section 5, as shown in FIG. 9, with a view to solving the foregoing problems. This known double-wall casing structure will be referred to as "complete double-wall casing structure", for simplicity.

Basically, thermal stress induced in a casing is proportional to the temperature difference between the outer and inner surfaces of the casing. Supposing that a casing is a thin-wall cylindrical structure for simplicity, steady circumferential thermal stress due to the temperature difference between the outer and inner surfaces in the thin-wall cylindrical structure is expressed by: $\sigma\theta t=0.714\alpha\times E\times T$, where $\sigma\theta t$ is steady thermal stress, $\alpha$ is the linear thermal expansion coefficient of the material of the thin-wall cylindrical structure, and T is the temperature difference between the outer and inner surfaces in the thin-wall cylindrical structure.

The temperature difference T1 between the outer and inner surfaces of the casing in the single-wall casing structure can be divided into 0.7×T1 in the outer casing of the double-wall casing structure, and 0.3×T1 in the inner casing of the same. Therefore, a steady thermal stress that will be induced in the inner casing of the double-wall casing structure is on the order of 0.7 times a thermal stress that will be induced in a single-wall casing structure. A steady thermal stress that will be induced in the outer casing of the double-wall casing structure is on the order of 0.3 times the thermal stress that will be induced in the single-wall casing structure. Thus, the steady thermal stress induced in the casing of the high-pressure section can be effectively reduced by using a double-wall casing structure.

Supposing that a casing is a thin-wall cylindrical structure for simplicity, circumferential stress induced in the thin-wall cylindrical structure due to the internal pressure therein is expressed by: $\sigma\theta p=a\times p/t$, where $\sigma\theta p$ is circumferential stress, and t is the thickness of the thin-wall cylindrical structure. Thus, the pressure difference P1 between the internal and the external pressure of the casing of the single-wall casing structure can be divided into 0.7×P1 for the outer casing of a double-wall casing structure, and 0.3×T1 for the inner casing of the double-wall casing structure.

Supposing that a casing is a thin-wall cylindrical structure, the radius of an inner casing of a double-wall casing structure is about 0.9×a and that of an outer casing of the double-wall casing structure is about 1.5×a, where a is the radius of a single-wall casing. Therefore, the wall thickness of the single-wall casing is $a\times P1/\sigma 1$, the wall thickness of the outer casing of the double-wall casing structure is about $0.45\times a\times P1/\sigma 2$ and the wall thickness of the inner casing of the double-wall casing structure is about $0.63\times a\times P1/\sigma 3$, where $\sigma 1$ is a circumferential pressure stresses induced in the single-wall casing, and $\sigma 2$ and $\sigma 3$ are circumferential pressure stresses induced in the inner and outer casings of the double-wall casing structure, respectively.

If those circumferential stresses may be equal, i.e., $\sigma 1=\sigma 2=\sigma 3$, the respective wall thicknesses of the inner and outer casings of the double-wall casing structure may be about 0.63 times and about 0.45 times the wall thickness of the single-wall casing, respectively.

Conversely, the respective wall thicknesses of the inner and outer casings of the double-wall casing structure may be about 0.9 times and about 0.65 times the wall thickness of the single-wall casing, respectively, if it is desired to limit the pressure stress induced in the double-wall casing structure to a value 0.7 times the pressure stress induced in the single-wall casing. That is, the double-wall casing structure achieves reduction in the pressure stress while reducing the wall thickness.

Thus, the double-wall casing structure, as compared with the single-wall casing, is capable of reducing both steady thermal stress and pressure stress.

On the other hand, in a state such as the turbine is starting up, the temperature of the casing rises sharply, a high thermal stress is induced unsteadily in the casing and the casing is deformed at the same time. The respective magnitudes of the thermal stress and the thermal deformation are basically proportional to the temperature difference between the inner and outer surfaces of the casing. This temperature difference is greatly dependent on the wall thickness of the casing in a state where steam temperature and heat transfer coefficient change sharply, such as a state where the turbine is starting up.

The temperature difference between the inner and outer surfaces of the single-wall casing is large, because the inner surface of the single-wall casing is exposed directly to main steam and the outer surface of the same is exposed indirectly through lagging materials to the atmosphere. On the contrary, with the double-wall casing structure, the temperature differences between the inner and outer surfaces of the outer and inner casings are smaller by far than that in the single-wall casing. This is because, temperature difference between the inner and outer surface of the casing structure is distributed between the inner and outer casings, and temperature of steam applied to the inner and outer surfaces of the casing structure is distributed between the inner and outer casings.

Generally, the respective magnitudes of the thermal stress induced unsteadily in the casing and the thermal deformation of the casing are proportional to the temperature difference between the inner and outer surfaces of the casing. Therefore, the thermal stress induced unsteadily in the casings of the double-wall casing structure and the thermal deformation of the casings of the double-wall casing structure are smaller than those of the single-wall casing.

Steels for making the casing of a steam turbine have low thermal conductivities. Thus, if the casing has a thick wall, the conduction of heat from the inner surface to the outer surface of the casing takes a long time and the temperature difference between the inner and outer surfaces of the casing is large. In this respect, a double-wall casing structure, in which the respective wall thicknesses of the inner and outer casings may be smaller than that of a single-wall casing, is effective in suppressing an excessive increase of unsteady thermal stress and unsteady thermal deformation.

Since a double-wall casing structure, as compared with a single-wall casing, reduces the temperature difference between the internal and external atmospheres of the casing and the wall thickness, the temperature difference between the inner and outer surfaces of the casing can be greatly reduced. Consequently, an excessive increase of thermal stress and thermal deformation at the start of the turbine can be suppressed.

As mentioned above, a double-wall casing structure, as compared with a single-wall casing, is capable of reducing pressure stress, steady thermal stress, unsteady thermal stress and unsteady thermal deformation. Hence, double-wall casing structure is effective in preventing creep damage, thermal fatigue damage and damage resulting from high temperature low-cycle fatigue to the casing, and troubles, such as steam leakage through the horizontal flange of the casing.

However, the complete double-wall casing structure is inevitably costly. This is because, the outer casing of the complete double-wall casing structure included in the high-pressure section of a conventional large-capacity, industrial steam turbine and entirely covering a part of steam turbine from the high-pressure first stage 7 to the high-pressure exhaust stage 8 is very large. Since the complete double-wall casing structure has complicated construction and needs a large number of bolts for fastening a casing-horizontal-flange joining together an upper and lower halves of the casing, assembling and disassembling the turbine for periodic inspection or maintenance requires complicated work and a long time. Consequently, periodic inspection and the like need increase costs, periodic inspection needs a long time, whereby the availability of the power generating system decreases and power generating cost increases.

It is a still more important problem that the employment of the complete double-wall casing structure enhances the risk of axial-rubbing. The thermal expansion of the outer casing of the complete double-wall casing structure is small because the temperature of steam on the inner surface of the outer casing is approximately equal to the temperature of high-pressure exhaust steam, which is the lowest of those of steam in the high-pressure section.

Therefore, the axial elongation difference between a rotor shaft 10 which is a rotating member and a part of the casing which is a stationary member, in the vicinity of a shaft seal 9 on the high-pressure exhaust side, is very large, as compared with such an axial elongation difference in a single-wall casing structure. This results in reduction in axial clearance. Consequently, the complete double-wall casing structure comes into axial contact with the rotor shaft 10 to cause axial vibrations generally called rubbing vibrations. Excessively intense axial vibrations hinder the operation of the turbine and increase greatly the risk of significantly getting the reliability of the turbine worse.

If the axial clearance is increased to reduce such risk, the amount of steam leakage through the shaft seal increases to make the performance of the turbine worse, which is undesirable from the viewpoint of performance. Actually, a considerably large axial clearance, as compared with an axial clearance required by the single-wall casing, must be secured in the shaft seal of the complete double-wall casing structure. Consequently, the leakage of steam through the shaft seal increases and make the performance of the turbine worse.

Those problems are true of other industrial steam turbines that are required to operate on high-pressure, high-temperature steam as well as of steam turbines for combined-cycle power generation.

Furthermore, since the steam turbine for combined-cycle power generation is a small-capacity or a medium-capacity, the flow of main steam is low and blade height is liable to become short and the performance of the steam turbine is worse. Therefore, by evaluating the relation between the root circle diameter and tip circle diameter of the moving blades desirable in respect of structural strength and performance of a steam turbine for combined-cycle power generation to enable the steam turbine to exercise satisfactory performance, the decline of the performance must be prevented.

SUMMARY OF THE INVENTION

The present invention has been made in view of the foregoing circumstances and it is therefore an object of the present invention to solve problems of securing strength at elevated temperatures and of preventing steam leakage that arise when high-pressure, high-temperature steam is used for driving a steam turbine, and problems of preventing the occurrence of rubbing due to excessive elongation difference and of minimizing steam leakage from shaft seals.

With the foregoing object in view, the present invention provides an axial-flow steam turbine, which includes a high-pressure section provided with a turbine casing, the turbine casing having: a double-wall casing structure, having an inner casing and an outer casing, arranged at an area corresponding to stages from a high-pressure first stage to a predetermined high-pressure stage arranged on an upstream side of a high-pressure final stage; and a single-wall casing structure arranged at an area corresponding to stages from a stage located next to said predetermined high-pressure stage to said high-pressure final stage.

The partial double-wall casing structure is preferably applied to a steam turbine that employs main steam having a pressure not lower than 120 kgf/cm$^2$ and a temperature not lower than 550° C., and has a rated output power of 120 MW or above.

It is also preferable that the double-wall casing structure is arranged so that steam pressure in a steam passage corresponding to the double-wall casing structure is 90 kgf/cm$^2$ or above, or that steam temperature in a steam passage corresponding to the double-wall casing structure is 480° C. or above.

The present invention also provides an axial-flow steam turbine, which includes a high-pressure section and an intermediate-pressure section, wherein steam discharged from the high-pressure section is reheated by a steam reheater, and the steam thus reheated is supplied to the intermediate-pressure section, wherein said high-pressure section has a turbine casing having: a double-wall casing structure, having an inner casing and an outer casing, arranged at an area corresponding to stages from a high-pressure first stage to a predetermined high-pressure stage arranged on an upstream side of a high-pressure final stage; and a single-wall casing structure arranged at an area corresponding to stages from a stage located next to said predetermined high-pressure stage to said high-pressure final stage, wherein said intermediate-pressure section has a turbine casing having: a double-wall casing structure, having an inner casing and an outer casing, arranged at an area corresponding to stages from an intermediate-pressure first stage to a predetermined intermediate-pressure stage arranged on an upstream side of an intermediate-pressure final stage; and a single-wall casing structure arranged at an area corresponding to stages from an intermediate-pressure stage located next to said predetermined intermediate-pressure stage to said intermediate-pressure final stage, and wherein said inner casings of the said high-pressure section and intermediate-pressure section are integrated.

The partial double-wall casing structures of the high and intermediate pressure sections are preferably applied to a steam turbine that employs main steam having a pressure not lower than 120 kgf/cm$^2$ and a temperature not lower than 550° C., and has a rated output power of 120 MW or above, and wherein a temperature of reheat steam is 550° C. or above.

It is also preferable that the double-wall casing structures of the high and intermediate pressure sections are arranged so that steam temperature in a steam passage corresponding to the double-wall casing structure is 480° C. or above.

In the event that the aforementioned partial double-wall casing structure is applied, it is preferable that the outer casing is made of a low alloy steel containing 1 to 3% Cr, such as a CrMoV alloy steel, and the inner casing is made of a Cr steel containing 8 to 10% Cr or a Cr steel containing 9.5 to 12.5% Cr. Alternatively, both the outer and inner casings may be made of a low alloy steel containing 1 to 3% Cr, such as CrMoV steel.

It is preferable that, in the stages of the high-pressure section corresponding to the double-wall casing structure, $0.85<Dr/Dt<0.95$, where Dr is root circle diameter including roots of moving blades and Dt is tip circle diameter including tips of the moving blades.

The steam turbine provided with the partial double-wall casing structures is suitable for use in combined-cycle power generating systems, thermal power plants without being combined with a gas turbine, or industrial power generating systems.

DESCRIPTION OF THE PREFERRED EMBODIMENTS

Preferred embodiments of the present invention will be described with reference to the accompanying drawings.

[First Embodiment]

Figure 1:
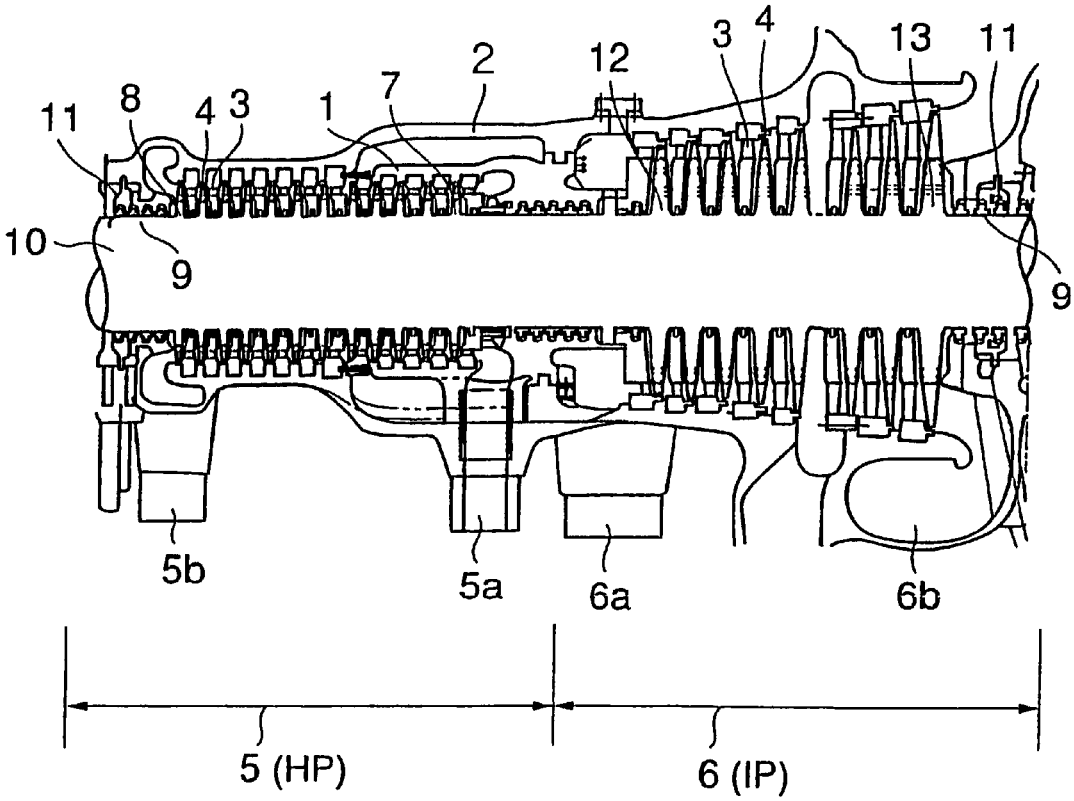
FIG. 1 is a longitudinal sectional view of principal parts of a high-pressure section and an intermediate-pressure section of a steam turbine in a first embodiment according to the present invention.

A steam turbine in a first embodiment according to the present invention will be described with reference to FIG. 1. FIG. 1 is a longitudinal sectional view of principal parts of a high-pressure section 5 and an intermediate-pressure section 6 of the steam turbine in the first embodiment, in which a low-pressure section is omitted.

Each of the high-pressure section 5 and the intermediate-pressure section 6 has a plurality of stages each consisting of a combination of stationary blades 3 and moving blades 4. The moving blades 4 of the high-pressure section 5 and the intermediate-pressure section 6 are attached to a common rotor shaft 10.

Main steam flows through an inlet port 5*a* into the high-pressure section 5, acts on a high-pressure first stage 7, flows sequentially through the rest of the high-pressure stages, leaves a high-pressure exhaust stage 8 and exhausts through an outlet port 5*b*. The steam exhausted through the outlet port 5*b* flows through an inlet port 6*a* into the intermediate-pressure section 6, acts on an intermediate-pressure first stage 12, flows sequentially through the rest of the intermediate-pressure stages, leaves an intermediate-pressure exhaust stage 13 and exhausts through an outlet port 6*b*.

Shown also in FIG. 1 are shaft seals 9 and casing attachments 11.

As shown in FIG. 1, the high-pressure section 5 has a double-wall casing structure, which is composed of an inner casing 1 and an outer casing 2. The double-wall casing structure is arranged at an area corresponding to the stages from the high-pressure first stage 7 to a predetermined high-pressure stage on the upstream side of the high-pressure exhaust stage 8 (from the high-pressure first stage 7 to a high-pressure fourth stage, with the embodiment of FIG. 1).

A single-wall casing structure, which has only the outer casing 2, is arranged at an area corresponding to the stages which follow said predetermined stage (high-pressure fourth stage with the embodiment of FIG. 1), in other words, from the high-pressure fifth stage to the high-pressure exhaust stage 8. As mentioned above, the casing of the high-pressure stage 5 has a "partial double-wall casing structure." As shown in FIG. 1, the outer casing 2 is formed continuously from the part corresponding to the high-pressure first stage 7 to the part corresponding to the high-pressure exhaust stage 8.

The high-pressure section 5 provided with the partial double-wall casing structure is preferably applied to steam turbines driven by main steam having a pressure of 120 kgf/cm$^2$ or above and a temperature of 550° C. or above, and having a rated output power of 120 MW or above. Preferably, the high-pressure section 5 is provided with the double-wall casing structure at an area where steam pressure in a steam passage is 90 kgf/cm$^2$ or above, or steam temperature in the steam passage is 480° C. or above.

Figure 2:
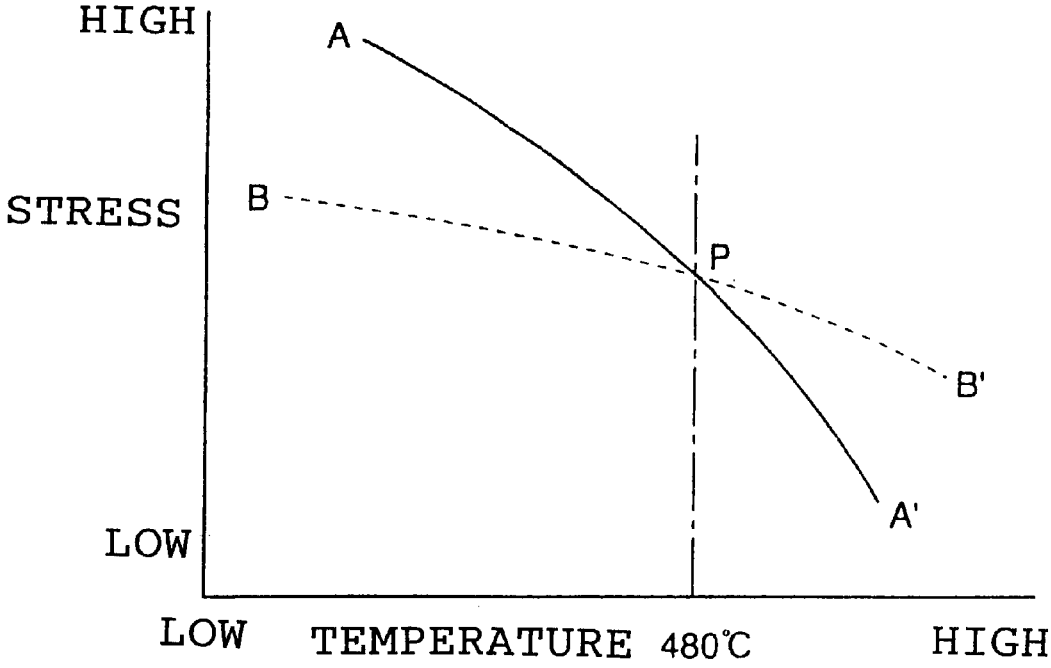
FIG. 2 is a graph showing the temperature dependence of the proof stress and the $10^5$-hours rapture strength of a material of a casing included in a steam turbine.

The reason for determining the area provided with the double-wall casing structure is as follows. Generally, the creep rate of materials of a casing of a steam turbine increases remarkable at temperatures exceeding 480° C. Therefore, the reduction of high-temperature strength due to creep must be taken into consideration in designing the casing. FIG. 2 is a graph showing the temperature dependence of the proof stress and the $10^5$-hour rapture strength of a material of a casing included in a steam turbine, in which stress S is measured on the vertical axis and temperature T is measured on the horizontal axis. As shown in FIG. 2, the proof stress varies with temperature along a broken line B–B', and the $10^5$-hour rapture strength varies along a continuous line A–A'. The broken line B–B' and the continuous line A–A' intersect each other at a point P substantially corresponding to 480° C.

The proof stress is used as a design criterion for a temperature range below about 480° C., and the $10^5$-hour rapture strength is used as a design criterion for a temperature range above about 480° C. Thus, a curve B-P-A' is used for finding a reference material strength in designing the casing. Therefore, the double-wall casing structure is employed at an area corresponding to stages exposed to heat of temperatures in the temperature range in which the strength of materials decreases sharply, in other words, stages exposed to heat of temperatures in a temperature range above 480° C. in which creep rupture strength must be used as a design criterion, to cope with the sharp reduction of material strength at high temperatures effectively.

The Plandtl number of steam has a significant influence on heat transfer coefficient. In a steam turbine used in a conventional thermal power plants and combined-cycle power plants for general thermal power generation, the Plandtl number of steam in a steam passage is about 1.0, and the steam has a temperature of about 480° C. and a pressure on the order of 90 kgf/cm$^2$.

Therefore, if an area of the casing corresponding to a steam passage in which the pressure of the steam is 90 kgf/cm$^2$ or above, or corresponding to a steam passage in which the temperature of steam is 480° C. or above, is provided with the double-wall casing structure, thermal stress induced in the casing and the axial elongation difference can be limited within design allowance ranges with sufficient tolerances, and the thermal deformation of the casing can be limited to a satisfactorily low level. Thus, a highly reliable, safe steam turbine free of damage and steam leakage that will hinder the continuation of operation can be provided.

As mentioned above, the high-pressure section of the steam turbine is provided with the double-wall casing structure at an area of the casing to be exposed to high-pressure, high-temperature steam, thereby suppressing the induction of excessively high thermal stress and the development of excessively large thermal deformation. In addition, the double-wall casing structure is not provided up to the high-pressure exhaust stage, in other words, the area where the double-wall casing structure is arranged is limited, thereby preventing the excessive increase of the axial elongation difference. Consequently, problems of ensuring high strength at high temperatures and reducing steam leakage involved in raising the temperature and pressure of steam for driving the steam turbine can be solved. Rubbing can be prevented by suppressing the development of excessive elongation difference and a safe steam turbine free of vibrations that hinder the operation of the steam turbine can be provided, and increase in manufacturing cost and operating cost can be suppressed.

Materials of the inner casing 1 and the outer casing 2 will be described hereinafter.

In the high-pressure section 5 of the steam turbine provided with the partial double-wall casing structure as shown in FIG. 1, it is preferable that the outer casing 2 is made of a low alloy steel containing 1 to 3% Cr, such as a CrMoV steel, and the inner casing 1 is made of a 9-Cr steel containing 8 to 10% Cr or a 12-Cr steel containing 9.5 to 12.5% Cr.

Reduction in manufacturing cost is achieved, by using the 12-Cr steel or the 9-Cr steel having a high high-temperature strength only for the inner casing 1 to be exposed to high-pressure, high-temperature steam. Increase in the axial elongation difference can be suppressed by forming only the specific part of the casing of the 12-Cr steel or the 9-Cr steel having a small thermal expansion coefficient. Consequently, increase in steam leakage through the shaft seals 9 due to big axial clearances can be prevented, and the risk of generating axial vibrations by axial rubbing can be reduced. Thus, the steam turbine can be manufactured at a low cost and can operate at a low operating cost.

The partial double-wall casing structure is far less subject to thermal deformation, and a thermal stress induced in the partial double-wall casing structure is far less than that induced in a single-wall casing structure. Therefore, both the inner casing 1 and the outer casing 2 may be made of a low alloy steel containing 1 to 3% Cr, typically CrMoV steel. Although the partial double-wall casing structure of such a low alloy steel requires careful consideration in designing the same, increase in the cost can be limited to the least extent, and the axial elongation difference is small. Therefore, steam leakage through the shaft seals can be minimized and axial rubbing can be effectively prevented.

Preferably, the moving blades 4 of the stages, which correspond to the area where the double-wall casing structure is employed, of the high-pressure section 5 meet an inequality: 0.85<Dr/Dt<0.95, where Dr is root circle diameter of the moving blades 4, and Dt is tip circle diameter of the moving blades 4. The reasons for this condition will be described hereinafter with reference to FIGS. 3 to 6.

Generally, the diameter of a rotor shaft 14 in a high-pressure section of a steam turbine for a combined-cycle plant is greater than that of the rotor shaft of a conventional steam turbine for thermal power generation equivalent in capacity thereto for the following reasons.

Figure 3:
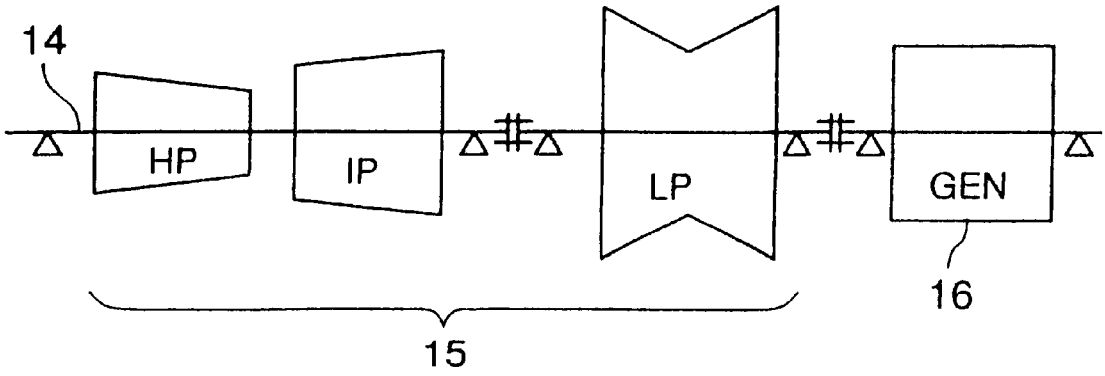
FIG. 3 is a schematic view of assistance in explaining the arrangement of a steam turbine and a generator in a conventional thermal power plant.

Referring to FIG. 3, a general, conventional thermal power plant has a steam turbine 15 and a generator 16. The diameter of a rotor shaft 14 included in a high-pressure section of the steam turbine 15 does not need to be big because the rotor shaft 14 needs to transmit only shaft torque generated by the high-pressure section of the steam turbine 15.

Figure 4A:
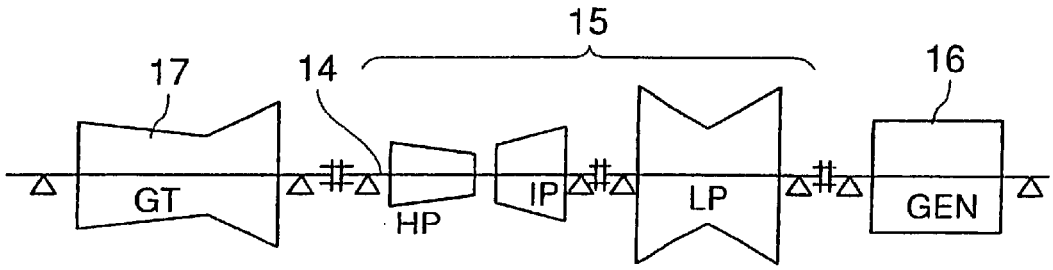
FIGS. 4A and 4B are schematic views of assistance in explaining the arrangement of a gas turbine, a steam turbine and a generator in a single-shaft combined-cycle power plant.
Figure 4B:
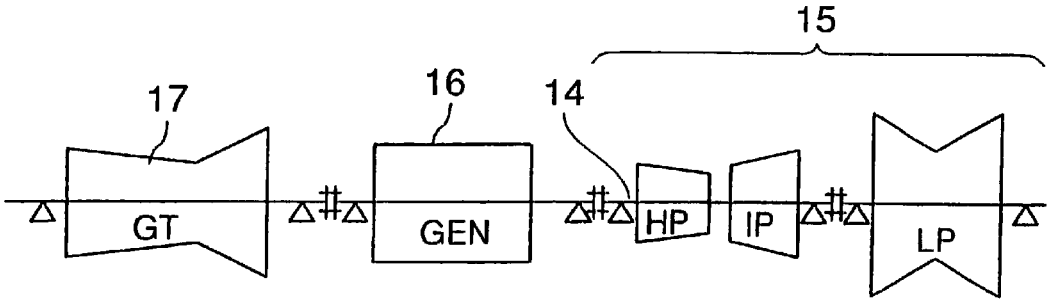

Recently, in a combined-cycle plant, a single-shaft power generating system formed by coaxially arranging g a gas turbine 17, a steam turbine 15 and a generator 16 as shown in FIG. 4 has been generally used. In the arrangement shown in FIG. 4, a shaft torque of the rotor shaft 15 of the high-pressure section of the steam turbine 15, and a shaft torque of the gas turbine 17 are used in combination. Therefore, the rotor shaft 14 of the high-pressure section of the steam turbine 15 must have a big diameter to have a necessary torsional strength.

Figure 5:
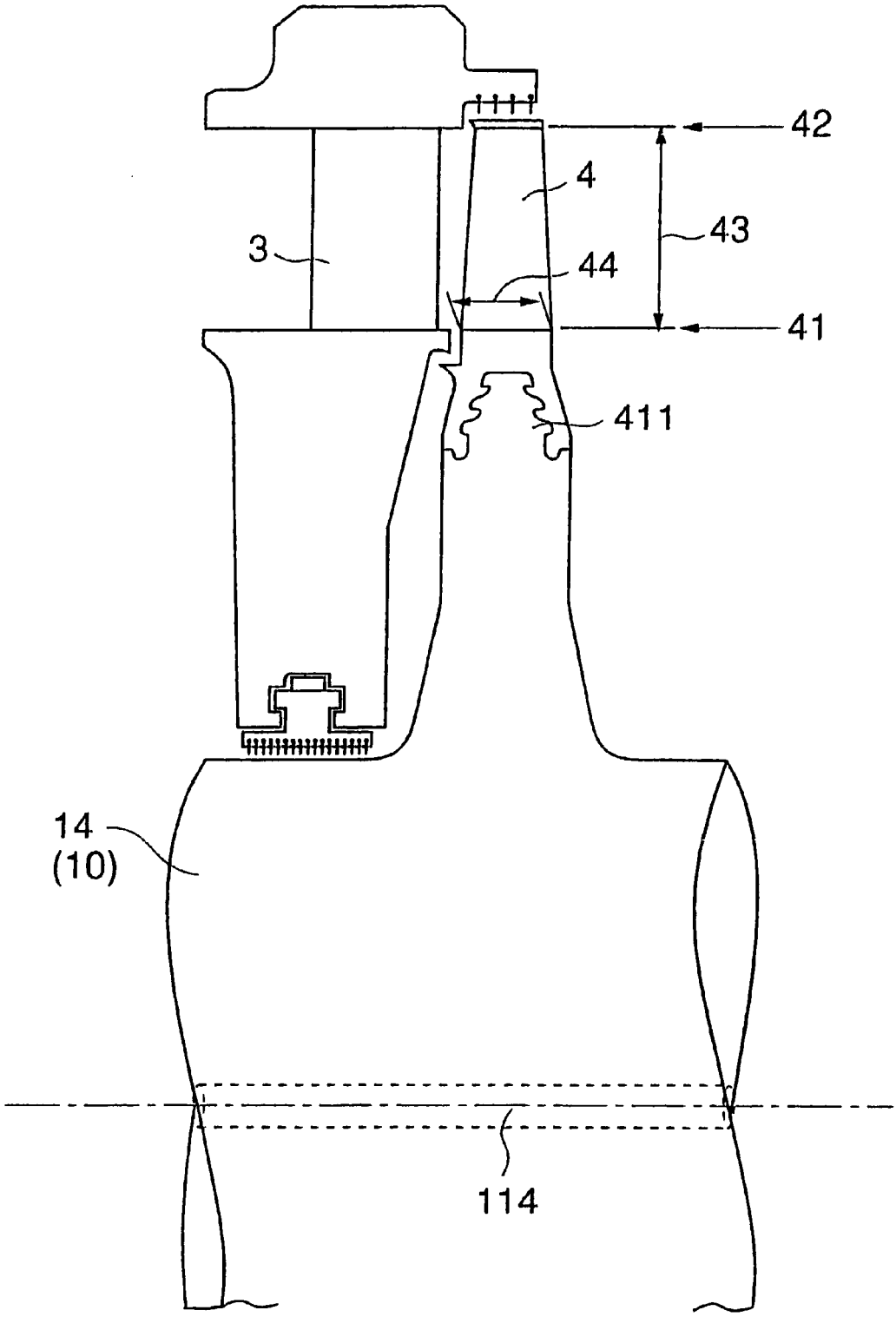
FIG. 5 is a side elevation of assistance in explaining the root and tip of a moving blade.

Referring to FIG. 5, if the diameter of the rotor shaft 14 of the steam turbine 15 is increased, the diameter of a circle including the roots of moving blades 4 increases accordingly. However, since the flow rate does not change, the blade height 43 of the moving blades 44 must be inevitably reduced to maintain the exit area of the moving blades substantially constant.

Supposing that the moving blade height 43 is Hb and the moving blade width 44 is Wb, the influence of a secondary flow in flows through the cascade increases sharply and the hydrodynamic performance of the moving blades deteriorates sharply when Hb/Wb<1. Therefore, falling into such a condition must be avoided.

Thus, it is desirable to increase the blade height of the moving blades of the high-pressure section having a short blade height, and it is desirable that Dr/Dt is small.

Generally, the blade width Wb of moving blades of the high-pressure section of a steam turbine for a single-shaft combined-cycle power plant having an output power of 120 MW or above is on the order of 20 mm at the minimum, and the root circle diameter Dr is about 800 mm at the smallest because it is difficult to reduce the root circle diameter Dr greatly. Therefore, it is important, for maintaining the performance of the steam turbine on a high level, to satisfy conditions expressed by:

$$\begin{aligned} Dr/Dt &< (Dt-2Hb)/Dt \\ &= 1-2Hb/Dt \\ &\approx 1-2Wb/(Dr+2Wb) \\ &\approx 1-2\times 20/(800+2\times 20) \\ &\approx 0.95 \end{aligned}$$

accordingly, Dr/Dt<0.95.

The high-pressure section of the steam turbine is exposed to high temperatures. In most cases, the stages of the high-pressure section corresponding to the double-wall casing structure are exposed to high temperatures not lower than 480° C. Therefore, stresses are induced in the materials of the moving blades and the rotor in a mode as shown in FIG. 2, and the reduction of the strength of the moving blades and the rotor at high temperatures is a significant problem. If the moving blades have an excessively big height, the moving blades are undergo creep damage and the probability of breakage of the moving blades or the rotor wheel while the steam turbine is in operation increases sharply.

Generally, a steam turbine is designed such that a local stress induced in a moving blade holding part 411 and a stress induced in a central part of a rotor shaft 14 are on the substantially same level. Since the root circle diameter Dr of the moving blades of a steam turbine is determined so that the performance of the steam turbine and manufacturing techniques are matched, the root circle diameters Dr of comparatively large steam turbines having an output power of 120 MW or above are not greatly different from each other.

Figure 6:
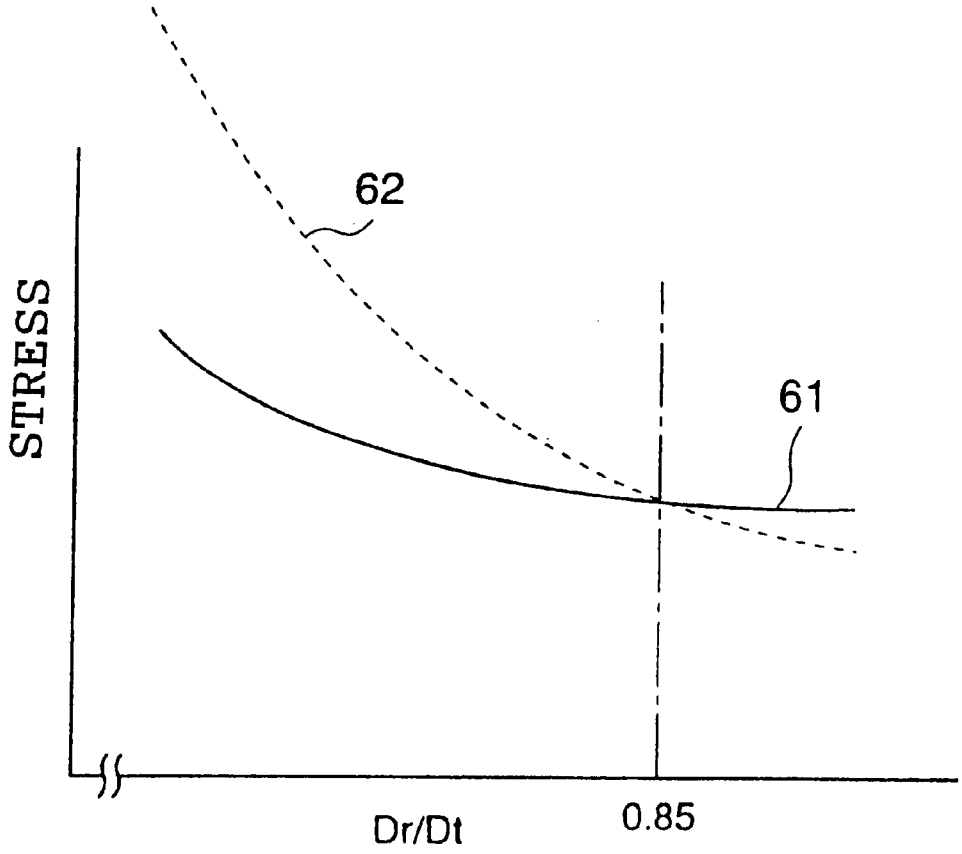
FIG. 6 is a graph showing the dependence of stress induced in a rotating part of a steam turbine on Dr/Dt.

Supposing that Dr is fixed, a local stress induced in a moving blade holding part and a circumferential stress induced in a central part of a rotor shaft decreases as Dr/Dt increases as shown in FIG. 6. Whereas the local stress induced in the moving blade holding part decreases sharply, the circumferential stress induced in the central part of the rotor shaft decreases gradually and changes scarcely in a range where Dr/Dt is high.

Generally, the circumferential stress induced in the central part of the rotor shaft remains at a level near the limit of strength of the rotor shaft in the high Dr/Dt range. Therefore, the design and manufacture of the rotor shaft on the basis of a stress far higher than such a circumferential stress are impossible. In a low Dr/Dt range, the local stress induced in the moving blade holding part exceeds the circumferential stress induced in the central part of the rotor shaft and increases sharply as the Dr/Dt decreases. Therefore the design and manufacture of the rotor shaft on the basis of data in such a range are difficult.

Referring to FIG. 6, it is known empirically that a curve 62 indicating the variation of the local stress with Dr/Dt and a curve 61 indicating the variation of circumferential stress with Dr/Dt intersect each other at a point corresponding a Dr/Dt of about 0.85. In a Dr/Dt range below 0.85, stress exceeds limit strength and hence a rotor having a Dr/Dt below 0.85 is unrealizable. Therefore, a steam turbine must meet: 0.85<Dr/Dt in view of the high-temperature strength of the rotating part of the steam turbine.

As obvious from the foregoing description, when the stages corresponding to the double-wall casing structure of the high-pressure section meet: 0.85<Dr/Dt<0.95, where Dr is root circle diameter and Dt is tip circle diameter, the deterioration of the performance of moving blades by the effect of the secondary flow can be prevented, the performance of the high-pressure section of the steam turbine can be maintained at a high level, and a highly reliable, safe steam turbine free of damage in the moving blades or the rotor wheel that may result in breakage can be provided.

[Second Embodiment]

Figure 7:
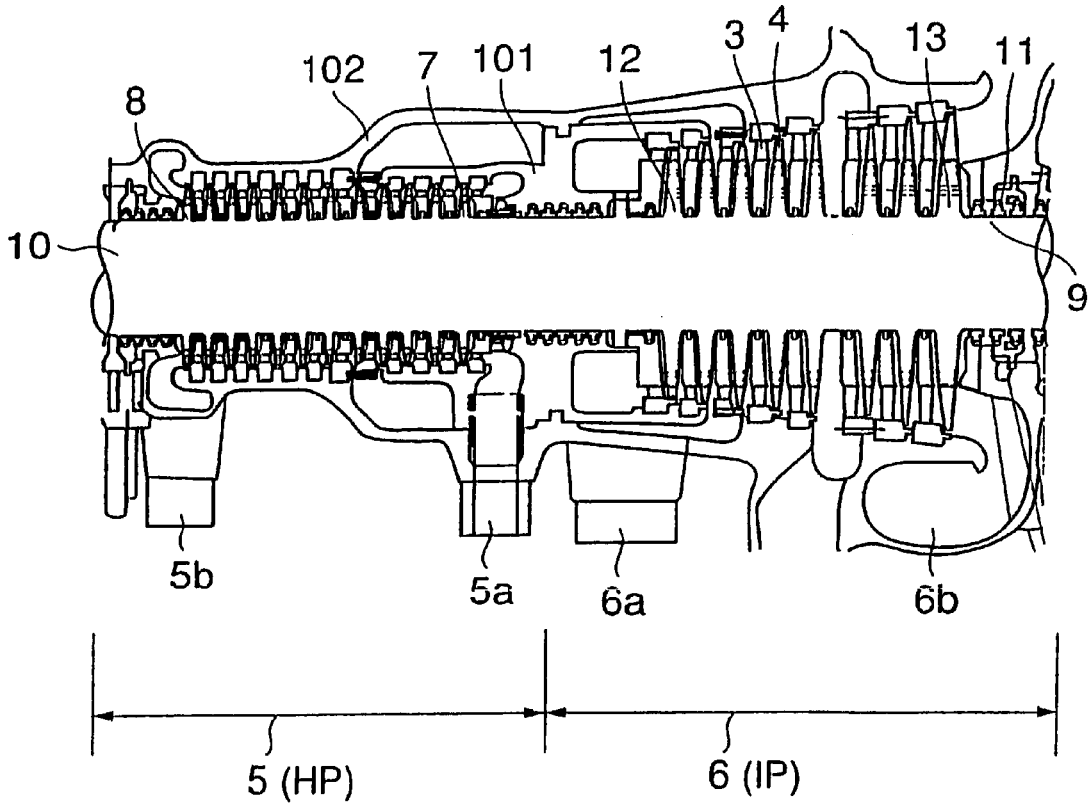
FIG. 7 is a longitudinal sectional view of principal parts of a high-pressure section and an intermediate-pressure section of a steam turbine in a second embodiment according to the present invention.
Figure 8:
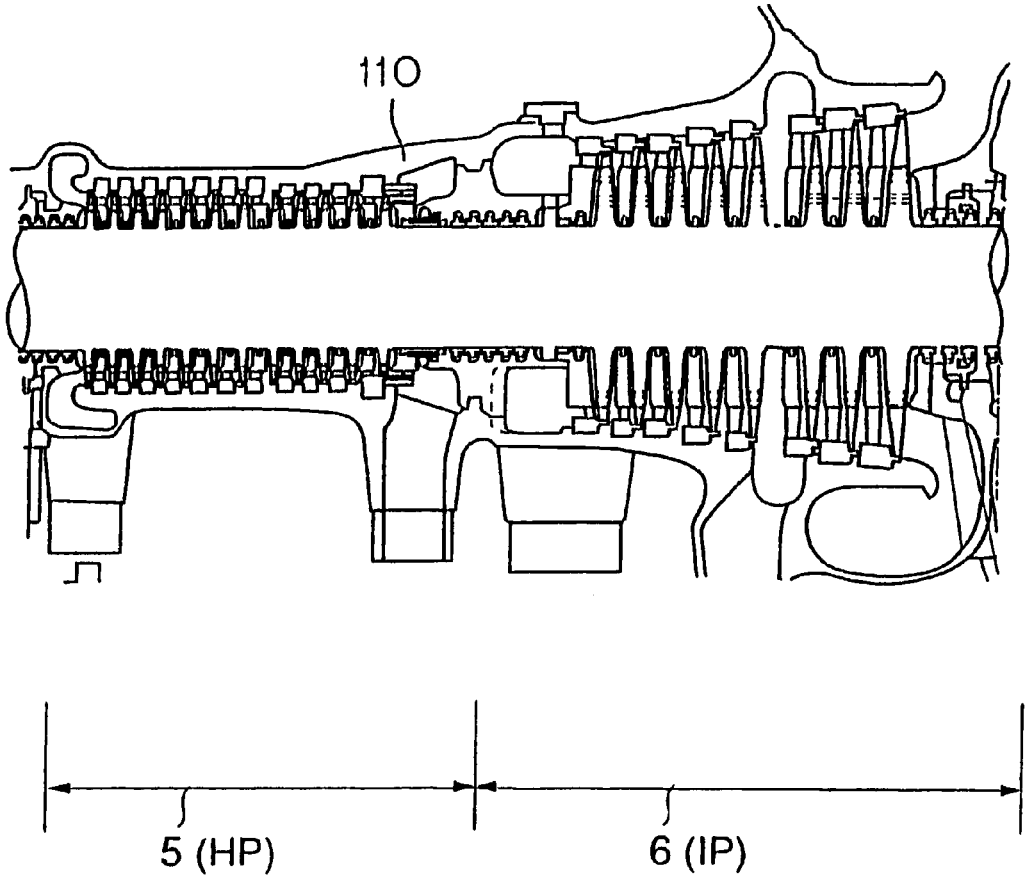
FIG. 8 is a longitudinal sectional view of principal parts of a high-pressure section and an intermediate-pressure section of a conventional steam turbine employing a single-wall casing structure.
Figure 9:
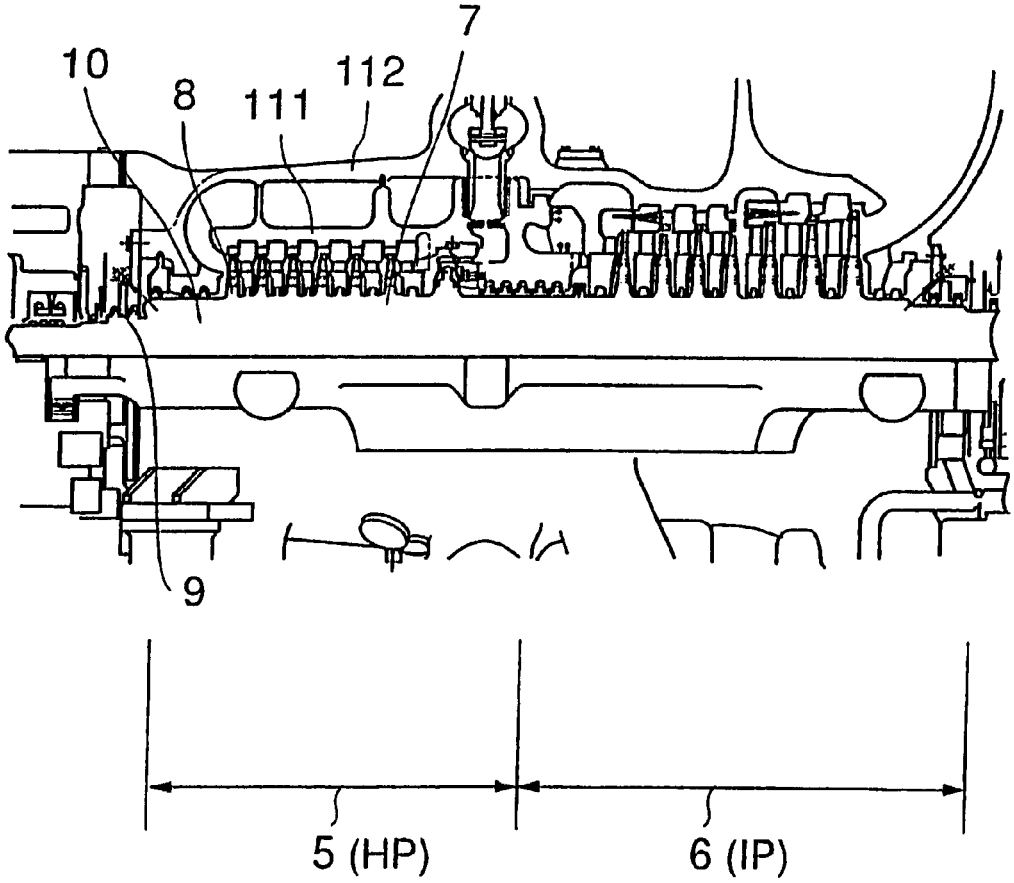
FIG. 9 is a longitudinal sectional view of principal parts of a high-pressure section and an intermediate-pressure section of a conventional steam turbine employing a complete double-wall casing structure in a high-pressure section.

A steam turbine in a second embodiment according to the present invention will be described with reference to FIG. 7. FIG. 7 is a longitudinal sectional view of principal parts of a high-pressure section 5 and an intermediate-pressure section 6 of the steam turbine in the second embodiment. In FIG. 7, a low-pressure section is omitted. In FIG. 7, parts like or corresponding to those of the first embodiment are denoted by the same reference characters and the description thereof will be omitted to avoid duplication.

The steam turbine in the second embodiment is a reheat cycle steam turbine that reheats steam discharged through an outlet port 5*b* of a high-pressure section 5 by a steam reheater, not shown, and supplies the reheat steam to an intermediate-pressure section 6 through an inlet port 6*a*.

The steam turbine in the second embodiment is suitable for use as a steam turbine using main steam of a pressure not lower than 120 kgf/cm$^2$ and a temperature not lower than 550° C., and having a rated output power of 120 MW or above.

As shown in FIG. 7, with the steam turbine in the second embodiment, similarly to that in the first embodiment, the high-pressure section 5 has a double-wall casing structure, which is composed of an inner casing 101 and an outer casing 102. The double-wall casing structure is arranged at an area corresponding to the stages from the high-pressure first stage 7 to a predetermined high-pressure stage on the upstream side of the high-pressure exhaust stage 8 (from the high-pressure first stage to a high-pressure fourth stage, with the embodiment of FIG. 7). A single-wall casing structure, which has only the outer casing 102, is arranged at an area corresponding to the stages which follow said predetermined stage.

With the steam turbine in the second embodiment, the intermediate-pressure section 6 also has a double-wall casing structure at an area corresponding to the stages from the intermediate-pressure first stage 12 to a predetermined intermediate-pressure stage on the upstream side of the intermediate-pressure exhaust stage 13 (from the intermediate-pressure first stage to a intermediate-pressure second stage, with the embodiment of FIG. 7). The steam turbine has a single-wall casing structure at an area corresponding to the stages which follow said predetermined stage, in other words, from the intermediate-pressure third stage to the intermediate-pressure exhaust stage. Thus, both the high-pressure section 5 and the intermediate-pressure section 6 are provided with the partial double-wall casing structures.

As shown in FIG. 7, the inner casing 101 is formed continuously from the part corresponding to the high-pressure fourth stage to the part corresponding to the intermediate-pressure second stage. Thus, the inner casing 101 covers both the high-pressure section 5 and the intermediate-pressure section 6, and is integrally formed for both the high-pressure section 5 and the intermediate-pressure section 6. Similarly, the outer casing 102 covers both the high-pressure section 5 and the intermediate-pressure section 6, and is integrally formed for both the high-pressure section 5 and the intermediate-pressure section 6.

Since high-temperature, high-pressure steam is supplied also to the intermediate-pressure section 6 of the steam turbine in the second embodiment, i.e., the reheat cycle steam turbine, the intermediate-pressure section 6 is provided with the partial double-wall casing structure. Thus, the second embodiment is substantially the same in operation and effect as the first embodiment.

The area of the intermediate-pressure section 6 provided with the double-wall casing structure may be determined on the basis of ideas explained previously in connection with the first embodiment. It is therefore preferable to arrange the double-wall casing structure at an area where the pressure of steam in the steam passage is 90 kgf/cm$^2$ or above with the double-wall casing structure, or where the temperature of steam in the steam passage is 480° C. or above.

The materials of the inner casing 101 and the outer casing 102 may be selectively determined on the basis of ideas previously explained in connection with the first embodiment. The outer casing 102 may be made of a low alloy steel containing 1 to 3% Cr represented by a CrMoV alloy steel, and the inner casing 101 may be made of a 9-Cr steel containing 8 to 10% Cr or a 12-Cr steel containing 9.5 to 12.5% Cr. Both the inner casing 101 and the outer casing 102 may be made of a low alloy steel containing 1 to 3% Cr represented by a CrMoV alloy steel.

The steam turbine provided with the foregoing partial double-wall casing structure (both the first and the second embodiments) is suitable for use in a combined-cycle power generating system including a gas turbine and a steam turbine. The steam turbine of the present invention is applicable to a combined-cycle power generating system including a steam-cooled gas turbine cooled by using steam. The steam turbine provided with the foregoing partial double-wall casing structure can be used in a thermal power plant that does not use the steam turbine in combination with a gas turbine or can be used in an industrial thermal power plant.

The use of the foregoing steam turbine in a thermal power plant suppresses the increase of the operating cost of the power plant operating under high steam conditions including high pressure and high temperature. The foregoing steam turbine exercises the same effect and operation not only when the same is used in a combined-cycle power plant, but also when the same is used in a thermal power plant not using the steam turbine in combination with a gas turbine or an industrial power generating system, and when raising the pressure and temperature of steam to be used.

What is claimed is:

1. An axial-flow steam turbine comprising a high-pressure section provided with a turbine casing, said turbine casing having: a double-wall casing structure, having an inner casing and an outer casing, arranged at an area corresponding to a part from an inlet part of said high-pressure stage to a predetermined high-pressure stage arranged on an upstream side of a high-pressure final stage; and a single-wall casing structure arranged at an area corresponding to stages from a stage located next to said predetermined high-pressure stage to said high-pressure final stage.

2. The steam turbine according to claim 1, wherein said steam turbine employs main steam having a pressure of 120 kgf/cm$^2$ or above and a temperature of 550° C. or above, and has a rated output power of 120MW or above.

3. The steam turbine according to claim 1 or 2, wherein said double-wall casing structure is arranged so that steam pressure in a steam passage corresponding to the double-wall casing structure is 90 kgf/cm$^2$ or above, or that steam temperature in a steam passage corresponding to the double-wall casing structure is 480° C. or above.

4. An axial-flow steam turbine comprising a high-pressure section and an intermediate-pressure section, wherein steam discharged from said high-pressure section is reheated by a steam reheater, and the steam thus reheated is supplied to said intermediate-pressure section, wherein said high-pressure section has a turbine casing having: a double-wall casing structure, having an inner casing and an outer casing, arranged at an area corresponding to a part from an inlet part of said high-pressure stage to a predetermined high-pressure stage arranged on an upstream side of a high-pressure final stage; and a single-wall casing structure arranged at an area corresponding to stages from a stage located next to said predetermined high-pressure stage to said high-pressure final stage, wherein said intermediate-pressure section has a turbine casing having: a double-wall casing structure, having an inner casing and an outer casing, arranged at an area corresponding to a part from an inlet part of said intermediate-pressure stage to a predetermined intermediate-pressure stage arranged on an upstream side of an intermediate-pressure final stage; and a single-wall casing structure arranged at an area corresponding to stages from an intermediate-pressure stage located next to said predetermined intermediate-pressure stage to said intermediate-pressure final stage, and wherein said inner casings of the said high-pressure section and intermediate-pressure section are integrated.

5. The steam turbine according to claim 4, wherein said steam turbine employs main steam having a pressure of 120 kgf/cm$^2$ or above and a temperature of 550° C. or above, and has a rated output power of 120 MW or above, and wherein a temperature of the reheat steam is 550° C. or above.

6. The steam turbine according to claim 4 or 5, wherein in said high-pressure section and said intermediate-pressure section, said double-wall casing structure is arranged so that steam temperature in a steam passage corresponding to the double-wall casing structure is 480° C. or above.

7. The steam turbine to any one of claims 1 to 6, wherein said outer casing are made of a low alloy steel containing 1 to 3% Cr, such as a CrMoV alloy steel, and said inner casing are made of a Cr steel containing 8 to 10% Cr or a Cr steel containing 9.5 to 12.5% Cr.

8. The steam turbine according to any one of claims 1 to 6, wherein both the outer and inner casings are made of a low alloy steel containing 1 to 3% Cr, such as CrMoV steel.

9. The axial-flow steam turbine according to any one of claims 1 to 8, wherein, in said stages of the high-pressure section corresponding to said double-wall casing structure, $0.85<Dr/Dt<0.95$, where Dr is root circle diameter including roots of moving blades and Dt is tip circle diameter including tips of the moving blades.

10. A combined-cycle power generating system comprising a gas turbine and the axial-flow steam turbine according to any one of claims 1 to 9.

11. The combined-cycle power generating system according to claim 10, wherein the gas turbine is of a steam-cooled type cooled by using steam.

* * * * *